US010081914B2

(12) United States Patent
Lang et al.

(10) Patent No.: US 10,081,914 B2
(45) Date of Patent: Sep. 25, 2018

(54) SOFT CREPED TISSUE

(71) Applicant: Kimberly-Clark Worldwide, Inc., Neenah, WI (US)

(72) Inventors: Frederick John Lang, Neenah, WI (US); Christopher Lee Satori, Hortonville, WI (US); John Paul David, Appleton, WI (US); Thomas Joseph Dyer, Neenah, WI (US); Mike Thomas Goulet, Neenah, WI (US); Michael John Rekoske, Appleton, WI (US); Kenneth John Zwick, Neenah, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 15/565,921

(22) PCT Filed: Apr. 12, 2016

(86) PCT No.: PCT/US2016/027114

§ 371 (c)(1),
(2) Date: Oct. 12, 2017

(87) PCT Pub. No.: WO2016/176035

PCT Pub. Date: Nov. 3, 2016

(65) Prior Publication Data

US 2018/0094387 A1 Apr. 5, 2018

Related U.S. Application Data

(60) Provisional application No. 62/154,915, filed on Apr. 30, 2015.

(51) Int. Cl.

| | |
|---|---|
| ***D21H 17/33*** | (2006.01) |
| ***D21H 19/74*** | (2006.01) |
| ***D21H 27/00*** | (2006.01) |
| ***D21H 21/14*** | (2006.01) |

(52) U.S. Cl.

CPC ..... *D21H 17/33* (2013.01); *D21H 19/74* (2013.01); *D21H 21/146* (2013.01); *D21H 27/002* (2013.01)

(58) Field of Classification Search

CPC .... D21H 21/146; D21H 21/16; D21H 27/002; D21H 27/005; D21H 19/22; D21H 17/34; D21H 27/30; D21H 27/38; D21H 21/14; Y10T 428/24446; B31F 1/12

See application file for complete search history.

(56) References Cited

U.S. PATENT DOCUMENTS

| | | | | |
|---|---|---|---|---|
| 4,158,594 | A | 6/1979 | Becker et al. | |
| 7,807,023 | B2 * | 10/2010 | Dyer et al. | D21H 17/34 162/168.1 |
| 7,883,604 | B2 * | 2/2011 | Dyer et al. | D21H 19/20 162/168.1 |
| 8,834,678 | B2 * | 9/2014 | Druecke et al. | B31F 1/12 162/111 |
| 8,916,012 | B2 * | 12/2014 | Qin et al. | A61K 8/04 |
| 9,499,942 | B2 * | 11/2016 | Zwick et al. | D21H 27/30 |
| 2005/0045292 | A1 | 3/2005 | Lindsay et al. | |
| 2007/0137808 | A1 * | 6/2007 | Lostocco et al. | D21H 27/00 162/109 |
| 2007/0137810 | A1 * | 6/2007 | Dyer et al. | D21H 21/146 162/109 |
| 2012/0160400 | A1 * | 6/2012 | Calewarts et al. | B32B 37/02 156/183 |
| 2012/0164200 | A1 * | 6/2012 | Qin et al. | A61K 9/70 424/402 |
| 2012/0255694 | A1 * | 10/2012 | Druecke et al. | D21H 27/00 162/111 |
| 2014/0050889 | A1 * | 2/2014 | Zwick et al. | B32B 3/00 428/152 |
| 2014/0050890 | A1 * | 2/2014 | Zwick et al. | D21H 27/40 428/154 |
| 2014/0102650 | A1 * | 4/2014 | Qin et al. | D21F 11/002 162/111 |
| 2015/0176222 | A1 * | 6/2015 | Lindsay et al. | D21H 27/40 |
| 2016/0153142 | A1 * | 6/2016 | Zwick et al. | D21H 27/30 |
| 2016/0355990 | A1 * | 12/2016 | Zwick et al. | D21H 27/40 |
| 2018/0016749 | A1 * | 1/2018 | Zawadzki et al. | D21H 27/005 |

FOREIGN PATENT DOCUMENTS

| | | | |
|---|---|---|---|
| EP | 1 703 017 | A1 | 9/2006 |
| WO | WO 2012090129 | A2 * | 6/2012 |
| WO | WO 2014/200455 | A1 | 12/2014 |

* cited by examiner

*Primary Examiner* — Jose A Fortuna

(74) *Attorney, Agent, or Firm* — Kimberly-Clark Worldwide, Inc.

(57) ABSTRACT

The invention provides a creped tissue web having satisfactory softness without the excess use of water insoluble creping compositions. The satisfactory softness levels, which may be measured as TS7, are generally less than about 10.0 and may be achieved by creping the tissue web with less than about 100 mg/m2? (milligrams of creping composition per square meter of creping cylinder surface area) such as from about 25 to about 100 mg/m2? and more preferably from about 50 to about 75 mg/m2?. It was previously believed that water insoluble creping compositions need to be added at high add-on levels, such as 100 mg/m2? or greater to achieve a desirable softness at a given tensile strength. It has now been surprisingly discovered that the add-on of water insoluble creping composition may be reduced significantly by adding a water soluble adhesive to the creping composition.

17 Claims, No Drawings

SOFT CREPED TISSUE

BACKGROUND OF THE DISCLOSURE

Tissue products such as paper towels, facial tissues, bath tissues, are often designed to have a soft feel. Softness is typically increased by decreasing or reducing bonding between fibers within the tissue product. While potentially improving softness, inhibiting or reducing inter-fiber bonding may adversely affect other important properties, such as the strength of the tissue product.

In other instances, softness may be enhanced by the topical addition of a softening agent to the tissue product. The softening agent may comprise, for instance, a silicone chemistry and may be topically applied to the tissue product by printing, coating or spraying. Although softening agents, such as silicone chemistries, make the tissue product feel softer, the agents can be relatively expensive, reduce absorbent rate and capacity, and may adversely affect the strength of the product.

In other instances softness may be enhanced by creping the tissue web. For example, U.S. Pat. No. 7,785,443 discloses creping a tissue web using a non-fibrous alpha-olefin polymer. The non-fibrous alpha-olefin polymer forms a thin film onto the tissue web, a portion of which remains on the surface of the web after it is creped from the dryer surface. While creping the tissue web in this manner improves softness, the water insoluble nature of the non-fibrous alpha-olefin polymer presents challenges to tissue machine operation. Further, to achieve the desired softness levels the non-fibrous alpha-olefin polymer is generally applied to the dryer at significantly high add-on levels compared to conventional creping compositions. For example, the non-fibrous alpha-olefin polymer may be applied in excess of 100 mg of creping composition per square meter of Yankee dryer surface area compared to about 5 to about 15 mg/m$^2$ (milligrams per square meter of dryer surface area) for conventional creping compositions. The high add-on levels exacerbate the processing difficulties and increase costs.

Thus, there remains a need for treatments which improve softness without negatively affecting other important tissue product properties, such as strength, and which are compatible with current tissue machine operation. There also remains a need for treatments which produce the desirable tissue product improvements without excessive chemical usage or increased processing complexity and costs.

SUMMARY OF THE DISCLOSURE

It has now been discovered that the softness (measured as TS7) of a tissue web, and more particularly a creped tissue web, may be met or exceeded without the excess use of creping chemistry, more specifically without the excess use of water insoluble creping compositions such as a non-fibrous olefin polymer. For example, by creping a tissue web with a creping composition comprising a non-fibrous olefin polymer and a water soluble adhesive, a tissue web that is both sufficiently strong to withstand use, such as a tissue product having a geometric mean tensile (GMT) from about 700 to about 1,500 g/3" and more preferably from about 800 to about 1,000 g/3", and soft, such as a tissue having a TS7 value less than about 10.0, and more preferably less than about 9.5 and still more preferably less than about 8.5, may be produced. Moreover, these product properties may be achieved despite applying less than 100 mg/m$^2$ (milligrams per square meter of dryer surface area), and in certain embodiments less than about 80 mg/m$^2$, of water insoluble creping composition to the Yankee dryer. This discovery provides the flexibility to produce a tissue product with satisfactory softness at a given tensile strength while reducing the add-on of water insoluble creping compositions.

Hence, in one aspect, the present invention provides a creped tissue product produced by dispersing a furnish to form a fiber slurry; forming a wet tissue web; partially dewatering the wet tissue web; applying a non-fibrous olefin polymer at add on levels less than about 100 mg/m$^2$ and a water soluble adhesive to a creping cylinder; pressing the partially dewatered tissue web to the creping cylinder; drying the tissue web; creping the dried tissue web from the creping cylinder to produce a creped tissue web; calendering the creped tissue web and plying two or more creped tissue webs together to form a tissue product having a basis weight greater than about 25 grams per square meter (gsm), GMT greater than about 700 g/3" and a TS7 value less than about 10.0 and more preferably less than about 9.5 and still more preferably less than about 9.0, such as from about 8.0 to about 9.0.

In other aspects the invention provides a creped tissue product characterized in that the tissue product comprises at least one tissue web that has been creped using a creping composition comprising non-fibrous olefin polymer and a water soluble adhesive wherein the add on level of the non-fibrous olefin polymer is less than about 100 mg/m$^2$, the tissue product having a GMT greater than about 700 g/3" and a TS7 value from about 8.0 to about 9.5.

In still other aspects the invention provides a creped tissue product characterized in that the tissue product comprises at least one tissue web that has been creped using a creping composition comprising non-fibrous olefin polymer and a water soluble adhesive selected from the group consisting of polyoxazolines, polyamidoamine-epichlorohydrin resin, polyamine epichlorohydrin resin, polyvinyl alcohol, polyvinylamine, polyethylenimine, acrylamide polymers, polymethacrylamide, poly(acrylic acid), poly(methacrylic acid), poly(hydroxyethyl methacrylate), poly(n-vinyl pyrrolidinone), poly(ethylene oxide), saccharides, polysaccharides and modified polysaccharides, wherein the add on levels of the non-fibrous olefin polymer are from about 50 to about 100 mg/m$^2$ and the add-on levels of the water soluble adhesive are from about 1.0 to about 25 mg/m$^2$, the tissue product having a GMT greater than about 700 g/3" and a TS7 value from about 8.0 to about 9.5.

In yet other aspects the present invention provides a creped tissue product comprising two or more creped tissue plies, each tissue ply prepared by adding less than about 100 mg/m$^2$ of a creping composition consisting essentially of a non-fibrous olefin polymer and a water soluble adhesive, the tissue product having a GMT greater than about 700 g/3" and a TS7 value from about 8.0 to about 10.0.

Definitions

As used herein, the term "adhesive" generally refers to chemical additive(s) present on the dryer surface to adhere the wet tissue web to the dryer and control the adhesion level during the drying process such that energy can be imparted into the dry web during the creping step, resulting in a high quality creped tissue sheet.

As used herein the term "water soluble" generally refers to the ability of a material, such as a creping component according to the present disclosure, to be substantially dissolved into a solution when mixed with water at the concentrations required by the application of the process described herein. Preferably water soluble creping compositions of the present invention are soluble in water to at least one percent. Water solubility is determined prior to the product being used in the manufacture of the tissue product.

As used herein, the term "basis weight" generally refers to the bone dry weight per unit area of a tissue and is generally expressed as grams per square meter (gsm). Basis weight is measured using TAPPI test method T-220.

As used herein, the term "caliper" is the representative thickness of a single sheet (caliper of tissue products comprising two or more plies is the thickness of a single sheet of tissue product comprising all plies) measured in accordance with TAPPI test method T402 using a ProGage 500 Thickness Tester (Thwing-Albert Instrument Company, West Berlin, N.J.). The micrometer has an anvil diameter of 2.22 inches (56.4 mm) and an anvil pressure of 132 grams per square inch (per 6.45 square centimeters) (2.0 kPa).

As used herein, the term "layer" refers to a plurality of strata of fibers, chemical treatments, or the like within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "slope" refers to slope of the line resulting from plotting tensile versus stretch and is an output of the MTS TestWorks™ in the course of determining the tensile strength as described in the Test Methods section herein. Slope is reported in the units of mass per unit of sample width and is measured as the slope of the least-squares line fitted to the load-corrected strain points falling between a specimen-generated force of 70 to 157 grams (0.687 to 1.540 N) divided by the specimen width. Slopes are generally reported herein as having units of grams force (gf) or kilograms force (kgf).

As used herein, the term "geometric mean slope" (GM Slope) generally refers to the square root of the product of machine direction slope and cross-machine direction slope. GM Slope generally is expressed in units of kilograms (kg).

As used herein, the term "geometric mean tensile" (GMT) refers to the square root of the product of the machine direction tensile strength and the cross-machine direction tensile strength of the web. While the GMT may vary, tissue products prepared according to the present disclosure generally have a GMT greater than about 700 g/3", such as from about 700 to about 1,500 g/3" and more preferably from about 750 to about 1,000 g/3".

As used herein, the term "Stiffness Index" refers to the quotient of the geometric mean tensile slope, defined as the square root of the product of the MD and CD slopes (typically having units of kgf), divided by the geometric mean tensile strength (typically having units of gf).

$$\text{Stiffness Index} = \frac{\sqrt{MD\ \text{Tensile Slope (kgf)} \times CD\ \text{Tensile Slope (kgf)}}}{GMT\ (\text{g}/3'')} \times 1{,}000$$

While the Stiffness Index may vary tissue products prepared according to the present disclosure generally have a Stiffness Index less than about 18.0, more preferably less than about 16.0, still more preferably less than about 14.0 and still more preferably less than about 12.0.

As used herein, the term "T57" refers to the output of the EMTEC Tissue Softness Analyzer (commercially available from Emtec Electronic GmbH, Leipzig, Germany) as described in the Test Methods section. TS7 has units of dB V2 rms; however, TS7 may be referred to herein without reference to units. While the TS7 value may vary, tissue products prepared according to the present disclosure generally have a TS7 value less than about 10.0, such as from about 8.0 to about 10.0.

As used herein, the term "fine crepe structure" refers to the structure of crepe folds on the surface of a creped tissue web. Fine crepe structure is measured using the crepe structure test method described below. Fine crepe structure is reported as the percent coefficient-of-variation (% COV) at 200-390 μm. Generally a lower % COV value indicates a finer crepe structure, which generally translates to a softer, improved tissue web or product.

As used herein, a "tissue product" generally refers to various paper products, such as facial tissue, bath tissue, paper towels, napkins, and the like. Tissue products may comprise one, two, three or more plies. The tissue product may be a web of tissue spirally wound onto a core or may comprise individual folded sheets that may be stacked together. Normally, the basis weight of a tissue product of the present invention is less than about 80 grams per square meter (gsm), in some embodiments less than about 60 gsm, and in some embodiments from about 10 to about 60 gsm and more preferably from about 20 to about 50 gsm.

DETAILED DESCRIPTION OF THE DISCLOSURE

Generally, the present invention provides a creped tissue web having a softness that meets or exceeds satisfactory levels without the excess use of water insoluble creping compositions. The satisfactory level of softness, which may be measured as TS7, is generally less than about 10.0, and more preferably less than about 9.5, such as from about 8.0 to about 10.0. The satisfactory level of softness is surprisingly achieved by creping the tissue web with less than about 100 mg/m$^2$ (milligrams of creping composition per square meter of creping cylinder surface area) water insoluble creping composition, and more preferably about 90 mg/m$^2$ or less, such as from about 25 to about 80 mg/m$^2$, and more preferably from about 50 to about 75 mg/m$^2$. It was previously believed that water insoluble creping compositions, such as a non-fibrous olefin polymer, need to be added at high add-on levels, such as 100 mg/m$^2$ or greater to achieve a desirable softness at a given tensile strength. It has now been surprisingly discovered that the add-on of water insoluble creping composition may be reduced significantly by adding a water soluble adhesive to the creping composition.

Accordingly, tissue webs and products prepared according to the present disclosure are manufactured using a creping composition comprising a water insoluble component and water soluble component, and more specifically a non-fibrous olefin polymer and a water soluble adhesive. There exists a surprising synergistic effect between the non-fibrous olefin polymer composition and the water soluble adhesive, which allows the add-on of non-fibrous olefin polymer to be reduced to less than 100 mg/m$^2$ without negatively affecting softness. In fact, creping the web with lower amounts of non-fibrous olefin polymer in combination with a water soluble adhesive, maintains or improves softness while improving other product properties such as absorption rate.

In certain embodiments the non-fibrous olefin polymer may comprise an alpha olefin interpolymer of ethylene or propylene and at least one comonomer, each comonomer being selected from the group consisting of octene, heptene, hexene, decene, and dodecene. Suitable olefin polymers are disclosed, for example, in U.S. Pat. No. 7,883,604, the contents of which are incorporated by reference herein in a manner consistent with the present disclosure. In certain preferred embodiments the olefin polymer may comprise the alpha-olefin interpolymer of ethylene and the comonomer comprises 1-heptene, 1-hexene, 1-octene, 1-decene, or 1-dodecene. The olefin polymer is generally considered a thermoplastic resin and is not water soluble. Rather, the olefin polymer is typically formed as a dispersion when mixed with water. For instance, the olefin polymer may be present in the aqueous dispersion in an amount from about 10 to about 70 percent by weight, such as from about 20 to about 50 percent by weight. In addition to an olefin polymer, the aqueous dispersion may also contain a dispersing agent. A dispersing agent is an agent that aids in the formation and/or the stabilization of the dispersion. Thus, in certain embodiments the creping composition may comprise one or more dispersing agents incorporated into the composition.

In addition to the non-fibrous olefin polymer the creping composition comprises a water soluble adhesive. Suitable water soluble adhesives may be selected from the group consisting of polyoxazolines, such as poly(2-ethyl-2-oxazoline), polyamidoamines, including silylated polyamidoamines and highly branched polyamidoamines and their reaction product with epichlorohydrin, such as polyamidoamine-epichlorohydrin and polyamine-epichlorohydrin resins, polyvinyl alcohol, polyvinylamine, polyethylenimine, acrylamide polymers, polymethacrylamide, poly(acrylic acid), poly(methacrylic acid), poly(hydroxyethyl methacrylate), poly(n-vinyl pyrrolidinone), polyethylene oxide), saccharides, polysaccharides, and modified polysaccharides, including for example starches, gums, chitosans, and modified celluloses such as hydroxyethyl cellulose, hydroxypropyl cellulose and carboxymethyl cellulose. In a still more preferred embodiment the water soluble adhesive component is selected from the group consisting of polyvinyl alcohol, polyethylene oxide), hydroxyethyl cellulose, hydroxypropyl cellulose, starch and carboxymethyl cellulose.

Additional components of the creping package may include a creping release agent, such as the release agents disclosed in U.S. Pat. No. 5,660,687, the contents of which are incorporated herein in a manner consistent with the present disclosure. Suitable release agents include, for example, aliphatic polyols or oligomers thereof having a number average molecular weight of less than 600, polyalkanolamines, aromatic sulfonamides, pyrrolidone, and mixtures thereof. Specific examples of release agents include, for example, ethylene glycol, propylene glycol, diethylene glycol, glycerol, pyrrolidone, triethanolamine, diethanolamine, polyethylene glycol and dipropylene glycol.

In a particularly preferred embodiment the water soluble adhesive component of the creping package is a polyvinyl alcohol. Suitable polyvinyl alcohols can be of any water soluble molecular weight sufficient to form an adhesive film. Generally, an average molecular weight of from about 13,000 to about 140,000 is preferred, such as from about 30,000 to about 100,000 and more preferably from about 40,000 to about 80,000. Suitable polyvinyl alcohols are commercially available under several trademarks such as Selvol™ (Sekisui Specialty Chemicals LLC, Dallas, Tex.), Elvanol® (DuPont Company, Wilmington, Del.) and Poval® (Kuraray Americas, Inc., Houston, Tex.). Useful commercially available polyvinyl alcohols may have a viscosity from about 3 to about 50 centipoise for a 4 percent aqueous solution at 20° C. and a degree of hydrolysis from about 85 to about 99 percent. Those skilled in the art will appreciate that lowering the degree of hydrolysis and the molecular weight will improve water solubility but may reduce adhesion.

The water soluble adhesive is generally added at lower add-on levels, such as from about 1.0 to about 30 mg/m$^2$, more preferably from about 1.0 to about 25 mg/m$^2$ and still more preferably from about 1.0 to about 10 mg/m$^2$, such as from about 2.0 to about 8.0 mg/m$^2$. Thus the ratio of non-fibrous olefin polymer to the water soluble adhesive added to the dryer surface, on a mass basis, may range from about 100:1 to about 5:1. Further, the total add-on of creping composition is generally less than about 150 mg/m$^2$ and more preferably less than about 125 mg/m$^2$ and still more preferably less than about 100 mg/m$^2$.

Surprisingly, despite adding less than about 100 mg/m$^2$ of the water insoluble component a tissue product may be produced having relatively low TS7 at a given strength, while also having generally low stiffness and favorable absorbent properties. Thus, in one embodiment the present invention provides a creped tissue product creped using a creping composition comprising a non-fibrous olefin polymer and a water soluble adhesive wherein the tissue product has a GMT greater than about 700 g/3", a TS7 value less than about 9.0 and a Stiffness Index less than about 18.0.

Generally the instant tissue products are less stiff than tissue products produced solely with a non-fibrous olefin polymer. As such, the present invention provides a creped tissue web having a Stiffness Index less than about 18.0, more preferably less than about 16.0, still more preferably less than about 14.0 and still more preferably less than about 12.0. In one embodiment the inventive tissue products have a GMT from about 700 to about 900 g/3" and a Stiffness Index from about 10.0 to about 15.0.

In other embodiments the tissue products also have well balanced absorbent properties and a Hercules Size Test (HST) less than about 3.0 seconds, such as from about 1.5 to about 3.0 seconds and more preferably from about 1.75 to about 2.5 seconds.

Further, the foregoing levels of softness and absorbent properties may generally be achieved without the addition of oils, waxes, silicones, latexes, fatty alcohols, or lotions comprising one or more emollients during manufacture of the tissue web or by post-treatment. For example, in certain embodiments, tissue webs and products prepared therefrom, may be prepared without post-treating (i.e., the addition of components by printing, spraying, coating, or the like after the web has been formed and dried to greater than about 95 percent consistency) the tissue web with oils, waxes, silicones, latexes, fatty alcohols, or lotions comprising one or more emollients.

Generally the non-fibrous olefin polymer and water soluble adhesive are applied to the creping cylinder during manufacture of the tissue web and transferred to at least one surface of the web. Preferably the creping compositions of the present disclosure are typically transferred to the web at high levels, such that at least about 30 percent of the creping composition applied to the surface of the creping cylinder is transferred to the web, more preferably at least about 45 percent is transferred and still more preferably at least about 60 percent is transferred. Generally from about 45 to about 65 percent of the creping composition applied to the surface of the creping cylinder is transferred to the web. Thus, the amount of creping additive transferred to the sheet is a function of the amount of creping additive applied to the dryer surface:

At the foregoing levels of add-on and transfer the amount of creping composition applied to each side of the web can be in the range of from about 0.1 to about 1.5 percent by weight, based upon the total weight of the web, such as from about 0.1 to about 1.0 percent by weight. Further, the creping composition is applied to the paper web so as to cover from about 15 to about 99 percent of the surface area of the web. More particularly, in most applications, the creping composition will cover from about 20 to about 60 percent of the surface area of the web.

Although such low levels of add-on of non-fibrous olefin polymer had not been previously believed to be suitable for producing soft tissue, it has now been discovered that combining lower levels of non-fibrous olefin polymer with a water soluble adhesive yields tissue webs having a TS7 value less than about 10.0, such as from about 8.0 to about 10.0 and more preferably from about 8.5 to about 9.5, at a GMT greater than about 700 g/3". The ability to produce a soft tissue at a given tensile strength using less non-fibrous olefin polymer is surprising as generally reducing the amount of non-fibrous olefin polymer reduces TS7 values (as illustrated in Table 1, below). It has now been demonstrated that by adding a water soluble adhesive the amount of non-fibrous olefin polymer may be reduced significantly, while actually improving product properties such as improved softness, reduced stiffness and better balance of absorbent properties. Not only does the present invention provide an improved product, reducing non-fibrous olefin polymer reduces operational costs and improves manufacture.

TABLE 1

| Non-fibrous olefin polymer ($mg/m^2$) | Water Soluble Adhesive ($mg/m^2$) | GMT (g/3") | GM Slope (kgf) | Stiffness Index | Softness TS7 |
|---|---|---|---|---|---|
| 100 | 0 | 932 | 14.00 | 15.0 | 9.58 |
| 75 | 10 | 811 | 11.07 | 13.6 | 8.66 |
| 50 | 10 | 807 | 11.29 | 14.0 | 8.89 |

Thus, it has now been demonstrated that the add-on of the water insoluble component may be reduced to less than about 100 $mg/m^2$ without negatively effecting important tissue product properties. As such, in certain embodiments, tissue products prepared according to the present invention generally have a TS7 value less than about 10.0 and more preferably less than about 9.5 and still more preferably less than about 9.0, such as from about 8.0 to about 9.5, a GMT from about 700 to about 1,500 g/3" and more preferably from about 750 to about 1,000 g/3", and a HST from less than about 3.0 seconds.

In other embodiments tissue webs and products prepared according to the present invention have a fine crepe structure. In certain embodiments the present invention provides a tissue web having a fine crepe structure less than 25% COV, measured at a wavelength from 200-390 μm, such as from about 15 to about 25% COV and more preferably from about 15 to about 20% COV. Thus, in one embodiment the present invention provides a creped tissue web comprising less than 100 mg creping composition per square meter of tissue web, the tissue web having a fine crepe structure from about 15 to about 20% COV, measured at a wavelength from 200-390 μm.

Not only are the instant tissue products soft (measured as TS7 value) and produced with a fine crepe structure, they may also have desirable absorption properties. For example, in certain embodiments the tissue products may have a HST less than about 3.0 seconds, such as from about 1.0 to about 3.0 seconds and more preferably from about 1.75 to about 2.5 seconds. Accordingly, in certain embodiments the present invention provides a soft and strong tissue having favorably balanced absorption properties such as a tissue product having a GMT from about 700 to 1,500 g/3", a TS7 value less than about 10.0 and more preferably less than about 9.5 and still more preferably less than about 9.0, such as from about 7.5 to about 9.5, and a HST less than about 3.0 seconds, such as from about 0.5 to about 3.0 seconds and more preferably from about 1.0 to about 2.5 seconds.

The tissue products of the present invention are preferably formed from cellulosic fibers and more preferably from wood fibers and still more preferably wood pulp fibers such as, but not limited to, northern softwood, southern softwood, redwood, red cedar, hemlock, pine (e.g., southern pines), spruce (e.g., black spruce), combinations thereof, and the like. Additionally, if desired, secondary fibers obtained from recycled materials may be used, such as fiber pulp from sources such as, for example, newsprint, reclaimed paperboard, and office waste.

Tissue webs useful in forming tissue products of the present invention can generally be formed by any of a variety of papermaking processes known in the art. For example, a papermaking process of the present disclosure can utilize adhesive creping, wet creping, double creping, embossing, wet-pressing, air pressing, through-aft drying, creped through-aft drying, as well as other steps in forming the paper web. Examples of papermaking processes and techniques useful in forming tissue webs according to the present invention include, for example, those disclosed in U.S. Pat. Nos. 5,048,589, 5,399,412, 5,129,988 and 5,494,554 all of which are incorporated herein in a manner consistent with the present disclosure. In one embodiment the tissue web is formed by creped through-air drying. When forming mufti-ply tissue products, the separate plies can be made from the same process or from different processes as desired.

In one embodiment the tissue product may be formed from creped, wet-pressed tissue webs. In the process, a head box delivers a furnish onto a forming fabric wrapped around a vacuum breast roll. The furnish may be at a fiber consistency of from about 0.08 to about 0.6 percent and, more desirably, at a fiber consistency of from about 0.1 to about 0.5 percent. Immediately after the vacuum breast roll, the forming fabric passes over the vacuum box to further vacuum dewater the embryonic web.

It should be noted that the type of headbox used is not critical to the practice of the method of the present invention. Any headbox which delivers a well-formed web may be employed. Further, although the embodiments discussed herein utilize a vacuum breast roll, this too is not critical to the practice of the method of the present invention. The method may be used with crescent formers, breast roll formers, twin wire formers and fourdriniers, as well as variations thereof.

The forming fabric may then pass through a transfer zone wherein the web is transferred onto a carrier felt. The transfer is made with the help of a vacuum pickup roll or transfer shoe. The transfer of the web from forming fabric to the carrier felt should be made when the web consistency is in the range of from about 18 to about 35 percent and is desirably in the range of from about 22 to about 32 percent.

The web is then transferred from the carrier felt to a Yankee dryer using a vacuum press roll. It is contemplated that other transfer mechanisms such as, for example, a transfer shoe, may be employed. The consistency of the web when transferred to the Yankee dryer may from about 35 to about 50 percent or more desirably, to a dryness ranging from about 40 to about 45 percent.

At the Yankee dryer, the creping chemicals are continuously applied by any convenient means, such as using a spray boom that evenly sprays the surface of the dryer with the creping solution. Generally, the point of application on the surface of the dryer is immediately following the creping doctor blade or cleaning doctor blade, permitting time for the spreading and drying of the creping solution.

The creping solution facilitates adhesive of the web to the Yankee dryer surface as it is transferred from the carrier felt. Once adhered to the Yankee surface the web is dried and then removed from the Yankee surface using a creping blade. The creping blade crepes the tissue from the Yankee surface yielding a substantially dry, creped, tissue web.

The substantially dry, creped, tissue web may be subjected to converting, such as calendering or embossing. In certain preferred embodiments the tissue webs are converted to tissue products by calendering alone, without embossing. Further, multiple tissue webs, such as two, three or four webs may be plied together to form a multi-ply tissue product. Generally, multi-ply tissue products of the present invention comprise two, three or four plies. The exact manufacture of individual plies may vary, but generally the basis weight of the tissue web will be from about 5 to about 50 gsm, such as from about 10 to about 40 gsm. The basis weights of the resulting tissue products may range from about 10 to about 80 gsm and more preferably from about 20 to about 60 gsm.

At the foregoing basis weights, the tissue webs and products of the present invention are generally strong enough to withstand use. As such the tissue products of the present invention generally have a GMT greater than about 700 g/3", such as from about 700 to about 1,500 g/3" and more preferably from about 750 to about 1,000 g/3". At these tensile strengths the products generally have a GM Slope less than about 15.0 kg and more preferably less than about 13.5 kg, such as from about 10.0 to about 15.0 kg. At the foregoing tensile strengths and modulus the tissue products generally have a Stiffness index less than about 18.0, more preferably less than about 16.0, still more preferably less than about 14.0 and still more preferably less than about 12.0.

TEST METHODS

Basis Weight

The basis weight was measured as bone dry basis weight. Basis weight of the tissue sheet specimens may be determined using the TAPPI T410 procedure or a modified equivalent such as: Tissue samples are conditioned at 23±1° C. and 50±2 percent relative humidity for a minimum of 4 hours. After conditioning, a stack of 16 3-inch by 3-inch samples are cut using a die press and associated die. This represents a tissue sheet sample area of 144 $in^2$ or 929 $cm^2$. Examples of suitable die presses are TMI DGD die press manufactured by Testing Machines, Inc., Islandia, N.Y., or a Swing Beam testing machine manufactured by USM Corporation, Wilmington, Mass. Die size tolerances are ±0.008 inches in both directions. The specimen stack is then weighed to the nearest 0.001 gram using an analytical balance. The basis weight in grams per square meter (gsm) is calculated using the following equation: Basis weight=stack weight in grams/0.0929.

Tensile

Samples for tensile strength testing are prepared by cutting a 3 inches (76.2 mm) by 5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 Newton or 100 Newton maximum, depending on the strength of the sample being tested, such that the majority of peak load values fall between 10 and 90 percent of the load cell's full scale value. The gauge length between jaws is 4±0.04 inches. The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is," and the arithmetic average of all individual specimen tests is either the MD or CD tensile strength for the product.

"Hercules Size Test" (HST)

The "Hercules Size Test" (HST) is a test that generally measures how long it takes for a liquid to travel through a tissue sheet. Hercules size testing was done in general accordance with TAPPI method T 530 PM-89, Size Test for Paper with Ink Resistance. Hercules Size Test data was collected on a Model HST tester using white and green calibration tiles and the black disk provided by the manufacturer. A 2 percent Napthol Green N dye diluted with distilled water to 1 percent was used as the dye. All materials are available from Ashland, Inc., Covington, Ky.

Six (6) tissue sheets (18 plies for a 3-ply tissue product, 12 plies for a two-ply product, 6 plies for a single ply product, etc.) form the specimen for testing. All specimens were conditioned for at least 4 hours at 23±1° C. and 50±2 percent relative humidity prior to testing. Specimens are cut to an approximate dimension of 2.5×2.5 inches. The specimen (12 plies for a 2-ply tissue product) is placed in the sample holder with the outer surface of the plies facing outward. The specimen is then clamped into the specimen holder. The specimen holder is then positioned in the retaining ring on top of the optical housing. Using the black disk, the instrument zero is calibrated. The black disk is removed and 10±0.5 mm of dye solution is dispensed into the retaining ring and the timer started while placing the black disk back over the specimen. The test time in seconds (sec.) is recorded from the instrument.

Tissue Softness

Tissue softness was analyzed using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. The frequency analysis in the range of approximately 200 to 1000 Hz represents the surface smoothness or texture of the test piece. A high amplitude peak correlates to a rougher surface. A further peak in the frequency range between 6 and 7 kHZ represents the softness of the test piece. The peak in the frequency range between 6 and 7 kHZ is herein referred to as the TS7 Softness Value and is expressed as dB V2 rms. The lower the amplitude of the peak occurring between 6 and 7 kHZ, the softer the test piece.

Test samples were prepared by cutting a circular sample having a diameter of 112.8 mm. All samples were allowed to equilibrate at TAPPI standard temperature and humidity conditions for at least 24-hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the TS7 Softness Values measurements are started via the PC. The PC records, processes and stores all of the data according to standard TSA protocol. The reported TS7 Softness Value is the average of 5 replicates, each one with a new sample.

Fine Crepe Structure

Wrinkle-free tissues specimens are cut to 2×3 inches, such that the machine direction runs parallel with the longer dimension. Samples are used as-is, that is one-ply samples are sampled as a single ply, while two-ply samples are sampled as two plies. Cut samples are mounted on a 10×12-inch glass plate by adhering with SCOTCH® tape, or equivalent, at their corners and along their sides. Each sample is "painted" with a 50:50 mixture of PENTEL® Correction Pen fluid and n-butanol, using a top quality camel's hair brush and applying in one direction parallel to the machine direction. This preparation will reduce light reflection and refraction.

A specimen is illuminated in a darkened room with a collimated light source produced by a slide projector or similar device. The projector used was a Kodak Ektagraphic slide projector (Model B-2) having a lens. The projector was connected to a Variable Auto-transformer, type 3PN1010, which was purchased from Staco Energy Products, Co. having an office in Dayton, Ohio. The auto-transformer is used to adjust the projector's illumination level. The projector with its attached lens was mounted on a support. In turn, the support was attached to a base. The collimated light source was adjusted to hit the top surface of the tissue specimen at an angle of 20 degrees. The prepared tissue sample is positioned flat on top of the auto-stage with the crepe pattern aligned orthogonal with respect to the light source, resulting in shadows cast by any crepe folds. The reflected light is viewed and an image acquired by a Leica Microsystems DFC-310 camera operated in monochrome mode having a 40-mm El-Nikkor lens (f-stop=4) with a 20-mm extension tube to generate a 1024×1024 pixel gray-scale image.

The DFC-310 video camera was mounted on a Polaroid MP-4 Land Camera (Polaroid Resource Center, Cambridge, Miss.) standard support. The support was attached to a KREONITE macro-viewer available from Kreonite, Inc., having an office in Wichita, Kans. An auto-stage, Prior Model H112/25T, was placed on the upper surface of the KREONITE macro-viewer. The auto-stage 146 is a motorized apparatus known to those skilled in the analytical arts which was purchased from Prior Scientific, Inc., having an office in Rockland, Mass. The auto stage was used to move the sample in order to obtain six separate and distinct, non-overlapping images from the approximately 3×2-inch size specimen. The glass plates with painted tissue are placed on the auto macro-stage of a Leica Microsystems QWIN Pro Image Analysis system, under the optical axis of a 40 mm El-Nikkor lens with a 20-mm extension tube. The sample is illuminated with a slide projector to form shadows.

The distance between the upper surface of the sample and the bottom of the lens was set to be approximately 7 cm. The vertical distance between the lens attached to the slide projector and the upper surface of the sample was set at 23 cm. The sample was illuminated by the slide projector. The horizontal distance between a vertical line extending to the center of the video camera lens and a vertical line extending to the center of the slide projector lens was set at 65 cm. These dimensions, combined with the video camera set-up, resulted in a field-of-view size of the sample surface to be approximately 8.8 by 8.8 mm.

The image analysis system used to acquire images was a QWIN Pro (v. 3.5.1) available from Leica Microsystems (Heerbrugg, Switzerland). A custom image acquisition program used to acquire and process gray-scale monochrome images using Quantimet User Interactive Programming System (QUIPS) language:

```
CONDITIONS: DFC 310 FX; 40 mm El-Nikkor lens (f/4) and 20 mm ext. tube; Projected,
collimated light @ 20 deg. angle; 50/50 PENTEL/n-Butanol coating on samples; mounted on 1/4" glass
plate.
    INITIALIZE VARIABLES
    CALVALUE = 8.57
    IMAGE = 0
    ACQOUTPUT = 1
    SET-UP AND CALIBRATION
    Configure (Image Store 1024 × 1024, Grey Images 45, Binaries 24)
    Clear Accepts
    Image frame ( x 0, y 0, Width 1024, Height 1024 )
    Measure frame ( x 30, y 150, Width 934, Height 700 )
    PauseText ("Enter image file prefix name.")
```

-continued

```
Input (TITLE$)
PauseText ("Position Sample and use Polaroid 803 reference to adjust white level to 0.5.")
Image Setup DC Twain [PAUSE] (Camera 1, AutoExposure Off, Gain 0.00, ExposureTime
78.43 msec, Brightness 0, Lamp 49.99)
Calibrate (CALVALUE CALUNITS$ per pixel)
For (SAMPLE = 1 to 3, step 1)
ROUTINE TO STABILIZE LIGHT LEVEL
Y = 0
Z = 0
SP = 0
SIB = 0
P = 0
MGREYIMAGE = 0
MGREYMASK = 0
FIELDS = 1000
TWICE = 0
Correlation GL Value for top 1% px Method, and DFC 310 FX = 187
For (LIGHT = 1 to 30, step 1)
 Image Setup DC Twain [PAUSE] (Camera 1, AutoExposure Off, Gain 0.00,
 ExposureTime 78.43 msec, Brightness 0, Lamp 49.99)
 Acquire (into Image0)
 Graphics (Inverted Grid, 1 × 1 Lines, Grid Size 930 × 693, Origin 30 × 151,
 Thickness 5, Orientation 0.000000, to Binary0)
 Image frame ( x 0, y 0, Width 1024, Height 1024 )
 Measure frame ( x 30, y 150, Width 934, Height 700 )
 Measure Grey ( plane MGREYIMAGE, mask MGREYMASK,
histogram into GREYHIST(256), stats into GREYSTATS(3) )
Selected parameters: Pixels, MeanGrey, Std Dev
  A = GREYSTATS(2)
  B = GREYSTATS(3)
  D = A+B
  For ( X = 129 to 256, step 1 )
   Y = Y+(X*GREYHIST(X))
   Z = Z+GREYH IST(X)
  Next ( X )
  R = Y/Z
  TP = GREYSTATS(1)
  ONEPCTPX = .01 * TP
  For ( X = 256 to 1, step −1 )
   If ( ONEPCTPX > SP )
    P = GREYHIST(X)
    SP = SP + P
    SIB = SIB +(X * P)
    If ( ONEPCTPX < SP )
     X = 1
End if
End if
Next ( X )
AVEGL = SIB / SP
E = AVEGL
Display ( E, field width: 8, left justified, 1 digit after '.', no tab follows )
If ( E<194 )
If ( E>190 )
TWICE = TWICE+1
If ( TWICE=2 )
Goto CONTINUE
End if
End if
End if
Y = 0
Z = 0
SP = 0
SIB = 0
Display ( Image0 (on), frames (on,on), planes (off,off,off,off,off,off), lut 0, x 0, y 49, z 1,
Reduction off )
 Next ( LIGHT )
END LIGHT STABILIZER ROUTINE
CONTINUE:
STAGE SCAN PARAMETERS
Stage ( Define Origin )
Stage ( Scan Pattern, 1 × 6 fields, size 13400.150391 × 6100.000000 )
IMAGE ACQUISITION AND DETECTION
For ( FIELD = 1 to 6, step 1 )
IMAGE = IMAGE+1
Image Setup DC Twain ( Camera 1, AutoExposure Off, Gain 0.00, ExposureTime
Acquire ( into Image0 )
Grey Transform ( WSmooth from Image0 to Image1, cycles 2, operator Horiz )
The following line is the computer location where the acquired images are saved
ACQFILE$ = "C:\Images\65104 - Busch\"+TITLE$+"_"+STR$(IMAGE)+".TIF"
```

-continued

```
Write image ( from ACQOUTPUT into file ACQFILE$ )
Image frame ( x 0, y 0, Width 1024, Height 1024 )
Stage ( Step, Wait until stopped + 550 msecs )
Next ( FIELD )
PauseText ( "Position Plate to Analyze Next Tissue and click 'Continue.'" )
Image Setup DC Twain [PAUSE] ( Camera 1, AutoExposure Off, Gain 0.00, ExposureTime
78.43 msec, Brightness 0, Lamp 49.99 )
Next ( SAMPLE )
END
```

Prior to acquiring the first sample images, shading correction was performed using the QWIN software and a white 803 Polaroid film positive (or equivalent white material) covered with an opaque, translucent film. Alternatively, other non-glossy white films or sheets could be used. The system and images were also accurately calibrated using the QWIN software and a standard ruler with metric markings. The calibration was performed in the horizontal dimension of the video camera image.

After calibrating, a custom image acquisition program was executed via the QWIN software and this initially prompts the analyst to place the sample specimen within the field-of-view of the video camera. After positioning the specimen so the machine direction is parallel to the light source and the specimen is properly aligned for auto-stage motion, the analyst will then be prompted to adjust the light level setting (via the variable auto-transformer) to register between Gray-Level readings of 190-194. During this process of light adjustment, the algorithm OSC Tissue—1 will automatically display the current Gray-Level value on the video screen. After the light has been properly adjusted, the custom image acquisition acquires six images for a single tissue specimen.

Using the set-up described above, an image representing an 8.8 mm×8.8 mm field of view was generated and saved as a *.tif image file. Typically, 3 tissue specimens were selected per sample code and 6 images generated per tissue specimen resulting in 18 images generated per sample or code.

A custom Matlab software algorithm is used for this analysis. The algorithm is shown below.

```
% OSC Matlab FFT Filter_1
% Condtions: Uses gray-scale images generated from
% DGB, 11/6/2013
% EXCEL Output header
hdr={'Image','50-100um','100-200um','200-390um',
'390-790um','790-1580um'};
data(1,:)=[hdr];
% get the images
[fn,pn]=uigetfile('C:\Matlab\Images\Zhe - OSC Matlab
Method\*.*','Pick your images','MultiSelect','on');
for j=1:length(fn),
%% Read in image
fnimg=([pn fn{j}]);
a=imread(fnimg);
figure(1);clf;imshow(a);title('Original Image');
%% Create distance map for filtering
sz=size(a);bw=zeros(sz);half=floor(sz/2)+1;bw(half(1),
half(2))=1;
D=bwdist(bw);
figure(1);clf;imagesc(D);axis equal off;colorbar;
title('Distance Map');
%% Fourier Transform
% fourier
fa=fftshift(fft2(a)); % shift to put DC component at center
pa=fa.*conj(fa);    % power spectum
% hard to see anything in raw power, so log transform it
```

-continued

```
figure(1);clf;imagesc(log(1+pa));axis equal off;
%% Sweep Frequency Range
freqRng=[87 172;
    46 87;
    23 46;
    12 23;
    7 12];
clear mn sd cover;
for i=1:size(freqRng,1),
  % filter
  % -- note: unless you have DC signal back in, all the
  %   values are centered around zero. This is done by
  %   keeping the very center of the image (bw).
  fa1=fa.*(D>=freqRng(i,1) & D<freqRng(i,2) | bw);
  % convert back to real space
  ra1=ifft2(ifftshift(fa1));
  % in this example the values were real, but I suspect in
  % general there will be a small complex component
  ra1=real(ra1);
  mn(i)=mean(ra1(:));
  sd(i)=std(ra1(:));
  covar(i)=sd/mn;
  figure(1);clf;set(gcf,'color','w');
  subplot(1,3,1:2),imagesc(ra1);axis equal off;
  subplot(1,3,3),hist(ra1(:));
  xlabel('Value');ylabel('Frequency [#]');
  ttl=sprintf('Mean: %.2f, Stdv: %.2f, COV: %.2f',mn,
sd,covar);
  title(ttl);
  snapnow;
 end;
%% Output
data(j+1,:)=[{fnimg} num2cell([covar(:)'*100])];
%data=[{fnimg} num2cell([covar(:)'*100])];
end;
xlswrite('C:\Matlab\data\fft_output.xls',data);
```

Images were analyzed by running the algorithm in Matlab algorithm. The analyst is initially prompted to select the images located in the designated directory folder on the computer. After images are selected, the algorithm then processes each image and places the resulting data into an EXCEL spreadsheet located in a designated directory folder on the computer. The 200-390 μm range data set has been used to compare and contrast the surface of the crepe structure of different tissues.

EXAMPLES

Samples were made using a conventional wet pressed tissue-making process on a pilot scale tissue machine. Initially, northern softwood kraft (NSWK) pulp was dispersed in a pulper for 30 minutes at about 4 percent consistency at about 100° F. The NSWK pulp was then transferred to a dump chest and subsequently diluted with water to approximately 2 percent consistency. Softwood fibers were then pumped to a machine chest. Generally the softwood fibers were added to the middle layer in the 3-layer tissue structure. The NSWK content contributed approximately 25 to 35 percent of the final sheet weight. The specific layer splits (dryer layer/middle layer/felt layer) are as set forth in the table below.

*Eucalyptus* hardwood kraft (EHWK) pulp was dispersed in a pulper for 30 minutes at about 4 percent consistency at about 100° F. The EHWK pulp was then transferred to a dump chest and diluted to about 2 percent consistency. Generally the EHWK fibers were added to the dryer and felt layers of the 3-layer sheet structure and contributed approximately 65 to 75 percent of the final sheet weight. The specific layer splits (dryer layer/middle layer/felt layer) are as set forth in the table below.

Wet strength resin (Kymene™ 920A, Solenis LLC, Wilmington, Del.) was added to the NSWK and EHWK pulp as it was metered from the machine chest to the tissue machine. The amount of wet strength added to the furnish was 2 kg/MT and was incorporated into each layer of the three layered tissue sheet.

The pulp fibers from the machine chests were pumped to the headbox at a consistency of about 0.1 percent. Pulp fibers from each machine chest were sent through separate manifolds in the headbox to create a 3-layered tissue structure. The fibers were deposited onto a felt using a Crescent Former. The wet sheet, about 10 to about 20 percent consistency, was further dewatered via a pressure roll nip to a post-pressure roll consistency (PPRC) of about 40 percent. The partially dewatered sheet was adhered to the Yankee dryer due to the additive composition that is applied to the dryer surface. A spray boom situated underneath the Yankee dryer sprayed the creping composition, described in the present disclosure, onto the dryer surface at addition levels set forth in the table below.

The water insoluble creping composition comprised a non-fibrous olefin dispersion, sold under the trade name HYPOD 8510 (Dow Chemical Co., Midland, Mich.). The HYPOD 8510 was prepared at 10 percent solids and delivered at a total addition level as set forth in Table 2.

Water soluble creping components were prepared by dissolution of the solid polymers into water followed by stirring until the solution was homogeneous. Solutions of water soluble creping components were diluted depending on the desired spray coverage on the Yankee dryer.

Rezosol™ 8207N (Solenis LLC, Wilmington, Del.) was prepared by diluting with deionized water to 3 percent solids. Selvol® 523 or 15-103 (Sekisui Specialty Chemicals America, LLC, Dallas, Tex.) was prepared by slowly adding 55 lbs of Selvol® to an agitated tank containing 75 gallons of cold deionized water. An additional 25 gallons of cold deionized water were added. The agitated tank was then heated to 85-90° C. to dissolve the polymer. The solution was cooled (approximately 6 percent solids) and subsequently diluted with deionized water to about 0.5 percent solids before use. A carboxymethylcellulose solution was prepared by slowly adding 0.9 kg Aqualon™ Sodium Carboxymethylcellulose (Ashland, Inc., Covington, Ky.) to an agitated tank containing 48 gallons of deionized water. The tank was agitated for about one hour to dissolve the polymer; solution solids was about 0.5 percent solids.

The water insoluble and water soluble creping compositions were metered and further diluted with water to a final concentration depending on the desired add-on levels. The water soluble and water insoluble creping components were blended together immediately prior to spraying onto the Yankee dryer surface.

TABLE 2

| Sample | Layer Split Dryer/Middle/Felt (wt %) | HYPOD ™ 8510 ($mg/m^2$) | Rezosol ™ 8207N ($mg/m^2$) | Selvol ® 523 ($mg/m^2$) | Selvol ® 15-103 ($mg/m^2$) | Aqualon ™ CMC ($mg/m^2$) |
|---|---|---|---|---|---|---|
| Control 1 | 44/28/28 | 100 | — | — | | — |
| Inventive 1 | 44/32/24 | 75 | 10 | — | | — |
| Inventive 2 | 44/32/24 | 50 | 10 | — | | — |
| Inventive 3 | 44/32/24 | 100 | 10 | — | | — |
| Inventive 4 | 44/32/24 | 75 | 2.5 | — | | — |
| Inventive 5 | 44/32/24 | 75 | 1.0 | | | |
| Inventive 6 | 44/28/28 | 50 | — | 10 | | |
| Inventive 7 | 44/28/28 | 75 | — | 10 | | |
| Inventive 8 | 44/28/28 | 75 | — | — | 2.5 | — |
| Inventive 9 | 44/28/28 | 75 | — | — | | 10 |
| Inventive 10 | 44/28/28 | 75 | — | — | | 2.5 |

The sheet was dried to about 98 to 99 percent consistency as it traveled on the Yankee dryer and to the creping blade. The Yankee dryer was heated with 105 psi of steam pressure and the Yankee hood was set to a supply temperature of 650 to 750° F. to dry the sheet to a target sheet temperature of 250 to 260° F. before the creping blade. The creping blade, a 75-Proto-HY03 Durablade® (BTG, Eclépens, Switzerland) with a 15 degree grind angle, was loaded at a pressure of 60 psi. The crepe ratio was 1.27. The creping blade subsequently scraped the tissue sheet off of the Yankee dryer. The creped tissue basesheet was then wound onto a core into soft rolls for converting.

To produce the 2-ply facial tissue products two soft rolls of the creped tissue were then rewound, calendered between two steel rolls to a 2-ply caliper of approximately 230 microns, and plied together so that both creped sides were on the outside of the 2-ply structure. Mechanical crimping on the edges of the structure held the plies together. The plied sheet was then slit on the edges to a standard width of approximately 8.5 inches and folded, and cut to facial tissue length. Tissue samples were conditioned and tested. The results of the testing are summarized in Table 3, below.

TABLE 3

| Sample | Basis Weight (gsm) | Sheet Bulk (cc/g) | GMT (g/3") | GM Slope (kgf) | Stiffness Index | HST (sec) | Fine Crepe Structure (% COV at 200-390 μm) | TS7 |
|---|---|---|---|---|---|---|---|---|
| Control 1 | 31.5 | 6.6 | 932 | 14.00 | 15.0 | 2 | 18.57 | 9.58 |
| Inventive 1 | 31.2 | 7.3 | 811 | 11.07 | 13.6 | 1.8 | 18.79 | 8.66 |
| Inventive 2 | 30.7 | 6.7 | 807 | 11.29 | 14.0 | 1.6 | 17.95 | 8.89 |
| Inventive 3 | 31.8 | 6.7 | 876 | 12.63 | 14.4 | 1.7 | 17.76 | 9.33 |
| Inventive 4 | 29.8 | 7.0 | 861 | 14.22 | 16.5 | 2.7 | 16.46 | 9.20 |
| Inventive 5 | 29.8 | 6.7 | 863 | 14.58 | 16.9 | 2.0 | 17.18 | 9.19 |
| Inventive 6 | 31.2 | 7.1 | 941 | 14.20 | 15.1 | 2 | 18.18 | 9.25 |
| Inventive 7 | 31.4 | 7.4 | 878 | 13.09 | 14.9 | 2.1 | 18.2 | 8.91 |
| Inventive 8 | 31.1 | 8.0 | 822 | 11.81 | 14.4 | 2.3 | 20.00 | 8.83 |
| Inventive 9 | 30.8 | 7.1 | 810 | 12.81 | 15.8 | 2.1 | 16.43 | 9.10 |
| Inventive 10 | 31.0 | 7.2 | 811 | 12.17 | 15.0 | 2.6 | 16.84 | 8.57 |

In view of the foregoing description and examples, the present invention provides, in a first embodiment, a tissue product comprising at least one creped tissue web having a first side and an opposite second side, a creping composition disposed on the first side, the creping composition comprising a non-fibrous olefin polymer and a water soluble adhesive polymer, the tissue product having a GMT from about 700 to about 1,500 g/3" and a TS7 value less than about 10.0.

In a second embodiment the invention provides the tissue product of the first embodiment characterized in that at least one creped tissue web has been creped using a creping composition comprising non-fibrous olefin polymer and a water soluble adhesive wherein the add on level of the non-fibrous olefin polymer is less than about 100 mg/m$^2$.

In a third embodiment the invention provides the tissue product of the first or second embodiments characterized in that at least one creped tissue web has been creped using a creping composition comprising non-fibrous olefin polymer and a water soluble adhesive wherein the total add-on of creping composition is less than about 100 mg/m$^2$.

In a fourth embodiment the invention provides the tissue of any one of the first through third embodiments wherein the tissue product comprises two creped wet pressed tissue webs plied together.

In a fifth embodiment the invention provides the tissue product of any one of the first through fourth embodiments wherein the non-fibrous olefin polymer comprises an alpha olefin interpolymer of ethylene or propylene and at least one comonomer, each comonomer being selected from the group consisting of octene, heptene, hexene, decene, and dodecene and the water soluble adhesive polymer is selected from the group consisting of a water soluble adhesive selected from the group consisting of polyoxazolines, polyamideamine-epichlorohydrin resin, polyamine epichlorohydrin resin, polyvinyl alcohol, polyvinylamine, polyethylenimine, acrylamide polymers, polymethacrylamide, poly(acrylic acid), poly(methacrylic acid), poly(hydroxyethyl methacrylate), poly(n-vinyl pyrrolidinone), polyethylene oxide), saccharides, polysaccharides and modified polysaccharides.

In a sixth embodiment the invention provides the tissue product of any one of the first through fifth embodiments wherein the ratio of the non-fibrous olefin polymer to the water soluble adhesive polymer is from about 75:1 to about 5:1.

In a seventh embodiment the invention provides the tissue product of any one of the first through sixth embodiments wherein the product has a Stiffness Index less than about 18.0, more preferably less than about 16.0, still more preferably less than about 14.0 and still more preferably less than about 12.0.

In an eight embodiment the invention provides the tissue product of any one of the first through seventh embodiments wherein the product has a HST less than about 3.0.

In a ninth embodiment the invention provides the tissue product of any one of the first through eighth embodiments wherein the product has a fine crepe structure from about 15.0 to about 20.0% COV at 200-390 μm.

In a tenth embodiment the invention provides a creped tissue product characterized in that the tissue product comprises at least one tissue web that has been creped using a creping composition comprising non-fibrous olefin polymer and a water soluble adhesive wherein the add-on level of the non-fibrous olefin polymer is less than about 100 mg/m$^2$, the tissue product having a GMT greater than about 700 g/3" and a TS7 value from about 8.0 to about 10.0.

In an eleventh embodiment the invention provides the creped tissue product of the tenth embodiment wherein the add-on level of the non-fibrous olefin polymer is from about 50 to about 90 mg/m$^2$ and the ratio of the non-fibrous olefin polymer to the water soluble adhesive polymer is from about 10:1 to about 5:1.

In a twelfth embodiment the invention provides the tissue product of the tenth or eleventh embodiments wherein the product has a HST less than about 3.

In a thirteenth embodiment the invention provides a tissue product manufacturing process comprising the steps of dispersing a furnish to form a fiber slurry; forming a wet tissue web; partially dewatering the wet tissue web; applying a non-fibrous olefin polymer at add on levels less than about 100 mg/m$^2$ and a water soluble adhesive to a creping cylinder; pressing the partially dewatered tissue web to the creping cylinder; drying the tissue web; creping the dried tissue web from the creping cylinder to produce a creped tissue web; and plying two or more creped tissue webs together to form a tissue product having a Basis Weight greater than about 25.0 gsm, a GMT from about 700 to about 1,500 g/3" and a TS7 value less than about 10.0.

In a fourteenth embodiment the invention provides the creped tissue product of the thirteenth embodiment wherein the add-on level of the non-fibrous olefin polymer is from about 50 to about 90 mg/m$^2$ and the ratio of the non-fibrous olefin polymer to the water soluble adhesive polymer is from about 10:1 to about 5:1.

What we claim is:

1. A creped tissue product comprising at least one creped tissue web having a first side and an opposite second side, a creping composition disposed on 20 to about 60 percent of the surface area of the first side, the creping composition comprising a non-fibrous olefin polymer and a water soluble adhesive polymer, wherein the mass ratio of the non-fibrous olefin polymer to the water soluble adhesive polymer is from about 5:1 to about 75:1, the tissue product having a geometric mean tensile (GMT) from about 700 to about 1,500 g/3" and a TS7 value less than about 10.0.

2. The creped tissue product of claim 1 wherein the non-fibrous olefin polymer comprises an alpha olefin interpolymer of ethylene or propylene and at least one comonomer, each comonomer being selected from the group consisting of octene, heptene, hexene, decene, and dodecene and the water soluble adhesive polymer is selected from the group consisting of polyoxazolines, polyamidoamine-epichlorohydrin resin, polyamine epichlorohydrin resin, polyvinyl alcohol, polyvinylamine, polyethylenimine, acrylamide polymers, polymethacrylamide, poly(acrylic acid), poly(methacrylic acid), poly(hydroxyethyl methacrylate), poly(n-vinyl pyrrolidinone), poly(ethylene oxide), saccharides, polysaccharides and modified polysaccharides.

3. The creped tissue product of claim 1 having a GM Slope less than about 18.0 kg.

4. The creped tissue product of claim 1 having a Stiffness Index less than about 15.0.

5. The creped tissue product of claim 1 having a Fine Crepe Structure from 15 to about 20.0% COV at 200-390 μm.

6. The creped tissue product of claim 1 having a Hercules Size Test (HST) less than about 3.0.

7. The creped tissue product of claim 1 wherein the TS7 value is from about 8.0 to about 9.5 and the geometric mean tensile (GMT) is from about 750 to about 1,000 g/3".

8. The creped tissue product of claim 1 wherein the creping composition consists essentially of a non-fibrous olefin polymer and a water soluble adhesive polymer.

9. The creped tissue product of claim 1 having a Fine Crepe Structure from 15 to about 20% COV at 200-390 μm and a TS7 value from about 8.0 to about 10.0.

10. A multi-ply tissue product having a geometric mean tensile (GMT) from about 700 to about 1,500 g/3", and a TS7 less than about 10.0, characterized in that the tissue product comprises at least two creped tissue plies manufactured by a process in which the creping composition has a solids content less than 10 percent and consists essentially of a non-fibrous olefin polymer and a water soluble adhesive polymer wherein the mass ratio of the non-fibrous olefin polymer to the water soluble adhesive polymer is from about 5:1 to about 75:1 and the non-fibrous olefin polymer add-on is less than about 100 mg/m$^2$, the creping composition disposed on 20 to about 60 percent of the surface area of the first side.

11. The creped tissue product of claim 10 wherein the TS7 value is from about 8.0 to about 9.5 and the geometric mean tensile (GMT) is from about 750 to about 1,000 g/3".

12. The multi-ply tissue product of claim 10 having a GM Slope less than about 18.0 kg.

13. The multi-ply tissue product of claim 10 having a Stiffness Index less than about 15.0.

14. The multi-ply tissue product of claim 10 having a Fine Crepe Structure from 15 to about 20.0% COV at 200-390 μm.

15. The multi-ply tissue product of claim 10 having a Hercules Size Test (HST) less than about 3.0.

16. The multi-ply tissue product of claim 10 wherein the total add-on of creping composition is less than about 150 mg/m$^2$.

17. The multi-ply tissue product of claim 10 wherein the add-on of the non-fibrous olefin is less than about 80 mg/m$^2$ and the add-on of the water soluble adhesive component is from about 1.0 to about 10 mg/m$^2$.

* * * * *